US010874212B2

(12) United States Patent
Wood

(10) Patent No.: US 10,874,212 B2
(45) Date of Patent: Dec. 29, 2020

(54) LOCKING GUN MOUNTS

(71) Applicant: Lucas Tyler Wood, Snohomish, WA (US)

(72) Inventor: Lucas Tyler Wood, Snohomish, WA (US)

( * ) Notice: Subject to any disclaimer, the term of this patent is extended or adjusted under 35 U.S.C. 154(b) by 0 days.

(21) Appl. No.: 16/537,009

(22) Filed: Aug. 9, 2019

(65) Prior Publication Data

US 2020/0046116 A1 Feb. 13, 2020

Related U.S. Application Data

(60) Provisional application No. 62/716,521, filed on Aug. 9, 2018.

(51) Int. Cl.
*A47B 81/00* (2006.01)
*F41A 17/02* (2006.01)

(52) U.S. Cl.
CPC ..... *A47B 81/005* (2013.01); *F41A 17/02* (2013.01)

(58) Field of Classification Search
CPC ..... A47B 81/00; A47B 81/005; F41A 17/02
USPC ..... 211/64, 70.8
See application file for complete search history.

(56) References Cited

U.S. PATENT DOCUMENTS 2,316,995 A * 4/1943 Smith ..... A47B 81/005 224/570
2,542,343 A * 2/1951 Merrill ..... F41A 23/18 248/217.4
3,270,994 A * 9/1966 Machan ..... F16M 13/022 24/505
4,226,399 A * 10/1980 Henderson ..... E05B 71/00 211/64
4,747,280 A * 5/1988 Shaw ..... E05B 47/0002 211/64
4,881,386 A * 11/1989 Glines ..... B60R 7/14 70/19
4,915,273 A * 4/1990 Allen ..... B60R 7/14 211/64
4,936,531 A * 6/1990 Bauser ..... B60N 3/00 211/64
4,949,559 A * 8/1990 Glines ..... B60R 7/14 211/64
5,339,966 A * 8/1994 Bastiaans ..... A47B 81/005 211/4
5,438,787 A * 8/1995 McMaster ..... A47B 81/005 211/64
7,047,771 B2 * 5/2006 Tanos ..... E05B 15/0046 211/64
8,496,145 B2 * 7/2013 Sautter ..... B60R 9/045 224/315
9,381,866 B2 * 7/2016 Sautter ..... B60R 9/045

* cited by examiner

*Primary Examiner* — Stanton L Krycinski
(74) *Attorney, Agent, or Firm* — Paul B. Heynssens Attorney at Law, PLC

(57) ABSTRACT

A locking gun mount provides a top frame and a bottom frame coupled by a shaft tube with a spring that pushes the top and bottom frames apart. The locking gun mount also includes a locking mechanism that also functions to open and close the locking gun mount. Also included is a back plate coupling a lag bolt for securing the locking gun mount to a wall.

18 Claims, 5 Drawing Sheets

Locking
Gun
Mount
101

Second
Example of a
Locking
Gun
Mount
401

Second
Example of a
Locking
Gun
Mount
401

LOCKING GUN MOUNTS

CROSS-REFERENCE TO RELATED APPLICATION

This application claims the benefit of U.S. Provisional Patent Application No. 62/716,521 filed Aug. 9, 2018, the contents of which are hereby incorporated by reference.

TECHNICAL FIELD

This description relates generally to security devices and more specifically to wall mounted gun security devices.

BACKGROUND

Securing valuable and items like firearms can be a problem since owners of firearms often like to display their firearms. Safes or lockers offer secure locked storage but are heavy and expensive. Also, the firearms tend to be secured behind steel doors not allowing them to be displayed. Sometimes wood and glass gun cases are used to display guns. However, the security is severely lacking since the glass can be broken and the locks easily broken. Sometimes cable systems may be included to improve security, but such a system is only as secure as the item it is mounted to. It would be advantageous to have a gun mount system that allows quick firearm access, is secure, and allows display of the firearms.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a locking gun mount having a top frame and a bottom frame coupled by a shaft tube with a spring that pushes the top and bottom frames apart while keeping the top and bottom frame coupled together. The locking gun mount also includes a locking mechanism that also functions to open and close the locking gun mount. Also included is a back plate coupling a lag bolt for securing the locking gun mount to a wall.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a locking gun mount. Although the present examples are described and illustrated herein as being implemented in a locking wall mounted gun security system, the system described is provided as an example and not a limitation. As those skilled in the art will appreciate, the present examples are suitable for application in a variety of different types of security systems, such as securing a guitar, bicycle or the like.

Figure 1:
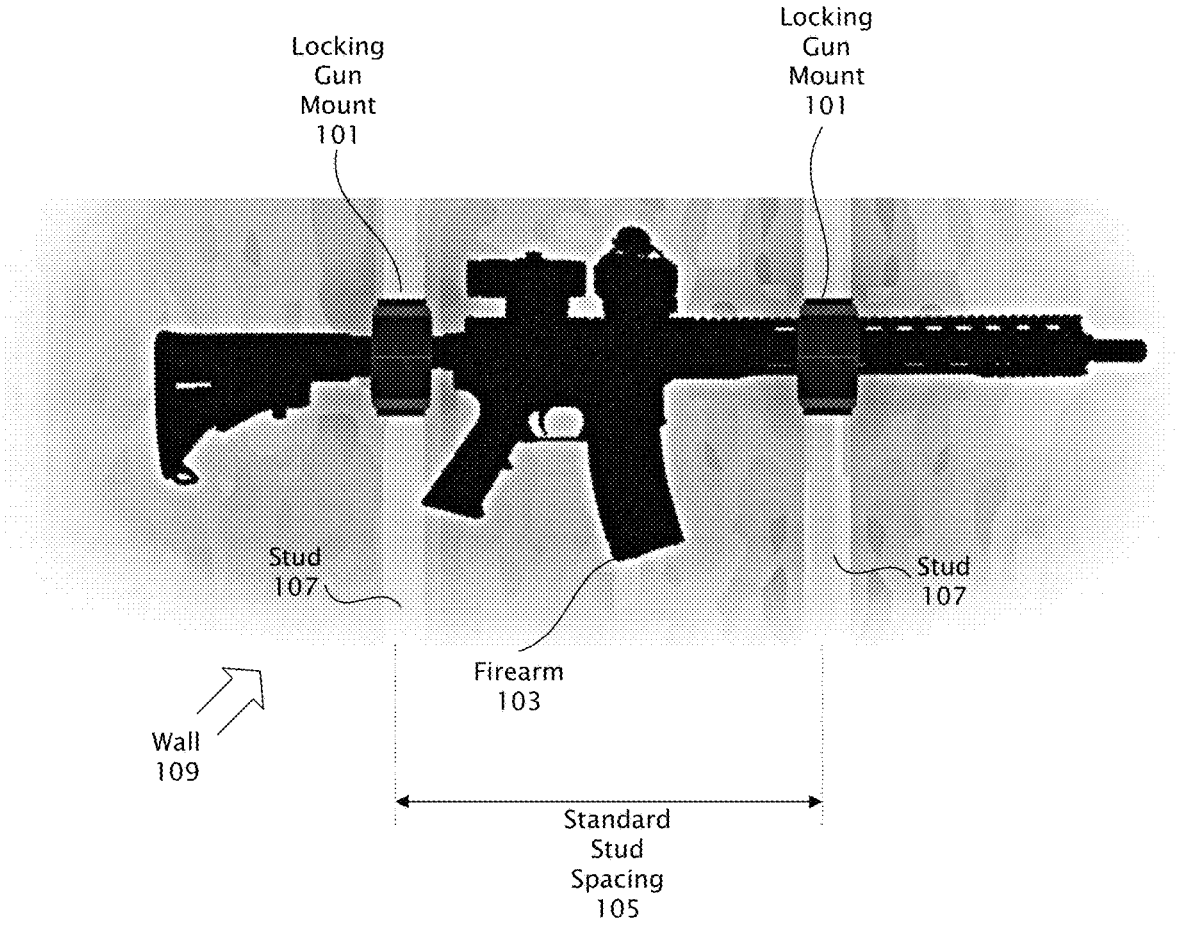
FIG. 1 shows the locking gun mount in use.
Figure 2:
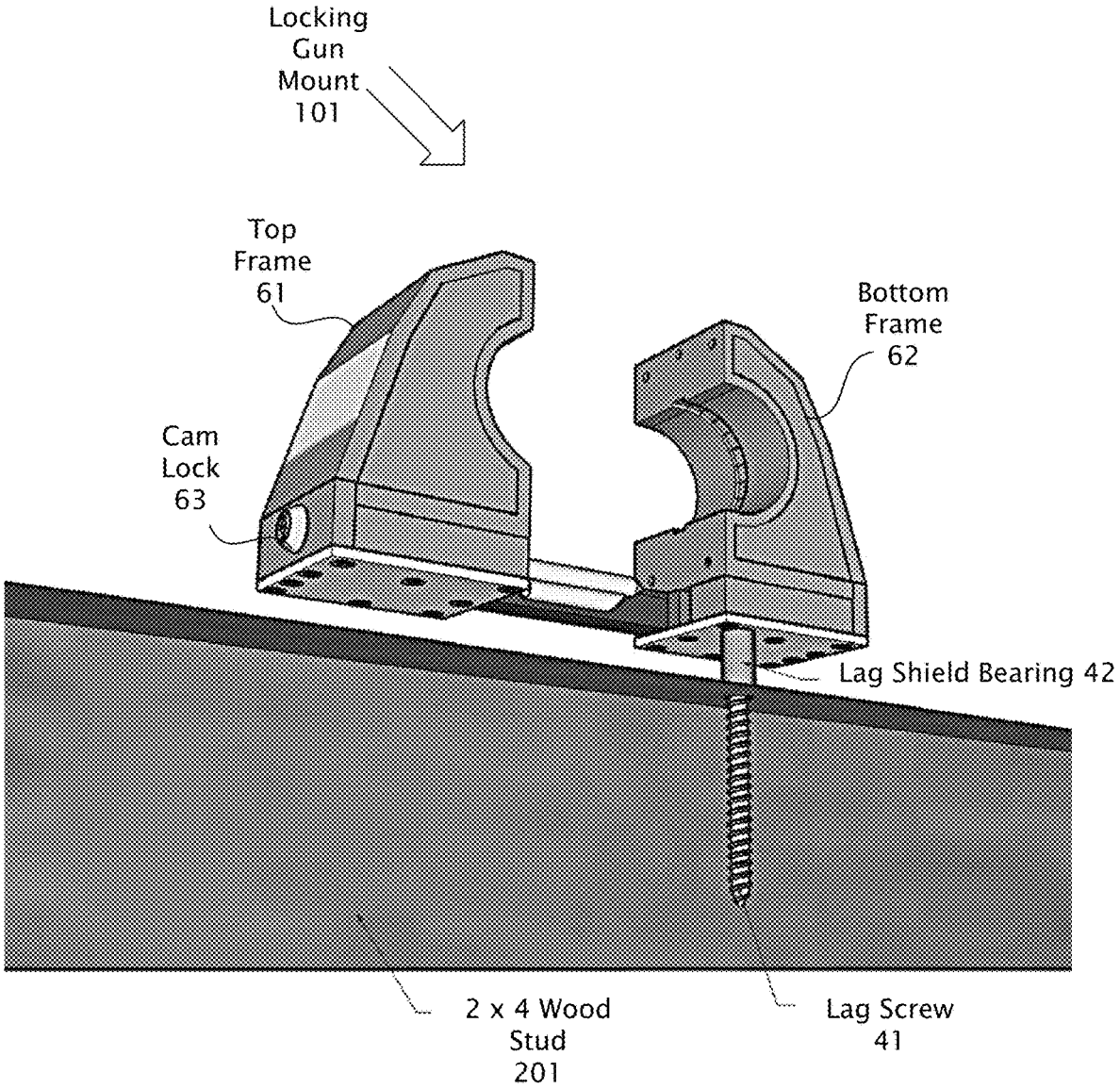
FIG. 2 shows the socking gun mount from the side and in the open position.
Figure 3:
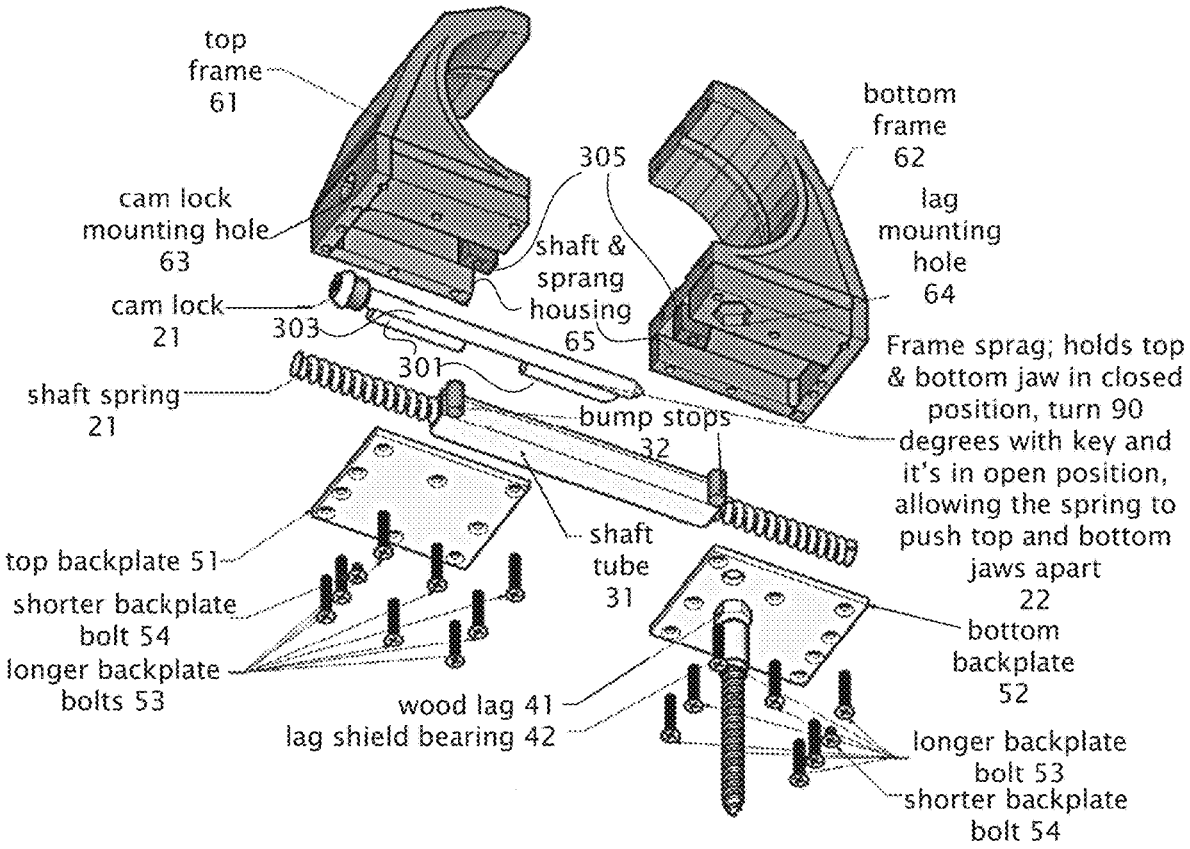
FIG. 3 is an exploded view of the locking gun mount.

The following description in relation to FIGS. 1-3 describes the construction and operation of a first example of a locking gun mount. The locking gun mounts includes two jaws or frames, top jaw 61 and lower jaw 62 with a spring 33 loaded shaft 31 holding them together which allows the assembly to slide open and shut closed. The locking mechanism 21 can turn 90 degrees and lock the jaws 61, 62 together in the closed position.

Locking gun mounts 101 will secure a rifle 103 to a wall or any object that would allow you to fasten them at the right distance apart from each other. Locking gun mounts will allow people to display their rifles and shotguns in a safe and secure way. FIG. 1 shows how the locking gun mounts are screwed into 2×4 studs, typically located at a standard stud spacing 105, within a wall. If one were to try to pry the locking gun mounts 101 off of the wall while there was a rifle 103 locked in them the attempt would likely damage the rifle 103 and it would take a significant amount of time and effort. Locking gun mounts 101 are also a cheap and easy alternative for gun safes they are lighter and they take up less space. The locking gun mounts also provide very fast spring loaded access to a rifle, as when they are unlocked they spring to an open position.

The locking gun mounts 101 are fastened to a wall or any object that would allow you to locate them at the sufficient distance apart from each other to accommodate a firearm 103. The locking gun mounts are typically attached to the wall (and stud 107) typically with a 5/16"×3" wood lag screw, or equivalent, into a 2×4 stud wall, (the wood lag screw can easily be switched out with a bolt for metal fastening applications). After the locking gun mounts 101 are fastened to the wall 109 the user will unlock both locking gun mounts 101 and the jaws 61, 62 will spring apart for easy gun insertion and removal. The spring loaded shaft 31, 32, 33 provides outward bias to cause the jaws 61, 62 to slide apart from each other. In closing the gun mount 101 the jaws 61 62 are pushed back together and the key (not shown) will turn causing protrusions on the frame sprag 22 to engage into recesses in the top 61 and bottom 62 frames, holding the jaws 61, 62 closed. Once the gun is inserted and ready to be secured, the user will push the top jaw 61 down till it touches the bottom jaw 62 and lock the jaws into the closed position using the frame sprag 22.

The locking gun mounts 101 are fabricated out of an assortment of materials such as steel aluminum, nylon and the like. The inside moving parts 22, 31, 32, 33 are typically made of moly coated stainless steel to allow the assembly to slide open and closed, and lock easily. The wood lag screw 41 and/or bolt is for fastening the locking gun mounts to a stationary object and is pinned into the bottom jaw 62. Accordingly the gun mount 101 is installed by turning the gun mount 101 about the axis of the lag screw 41 until the gun mount 101 is drawn into close proximity to the wall by the lag screw 41. The jaws 61, 62 typically are sized to provide a secure hold on the rifle.

Top frame 61 includes a cam lock mounting hole 63 and a shaft and sprag housing 65. Bottom frame 62 includes a shaft and sprag housing 65 and a lag mounting hole 64. Cam lock 21 includes a conventional cam lock coupled to a shaft having a pair of projections 301 coupled to an axial pin 303. When the pin 303 is rotated via a key, the projections 301 engage or disengage (depending on the direction the key is turned) form tabs 305. When the jaws 61, 62 are pressed together and the projections 301 engage the tabs 305 the jaws 61, 62 are locked together.

Shaft tube 31 includes bump stops 32 at opposite ends of the tube 31. Disposed in the tube 31 is a spring 33 that extends past the ends of the tube and provides outward bias to push out the jaws 61, 62. Bump stops 32 keep the jaws together as a single piece when opening, as the range of travel of the jaw opening is controlled.

A top back plate 51 is attached to the top frame 61 via screws 53, 54 of various lengths to hold the frame sprag and 22 and cam lock 21 captive to the top frame 61. A bottom back plate 52 is coupled to the bottom frame 62 via screws 53, 54 of various lengths to hold the frame sprag and 22 and cam lock 21 captive to the bottom frame 62. The bottom back plate also accommodates the lag screw 41, axially coupled to the lag shield bearing 42 via an aperture sufficient to accommodate the bearing, and with the head of the lag bolt 41 disposed in the lag mounting hole 64.

Figure 4:
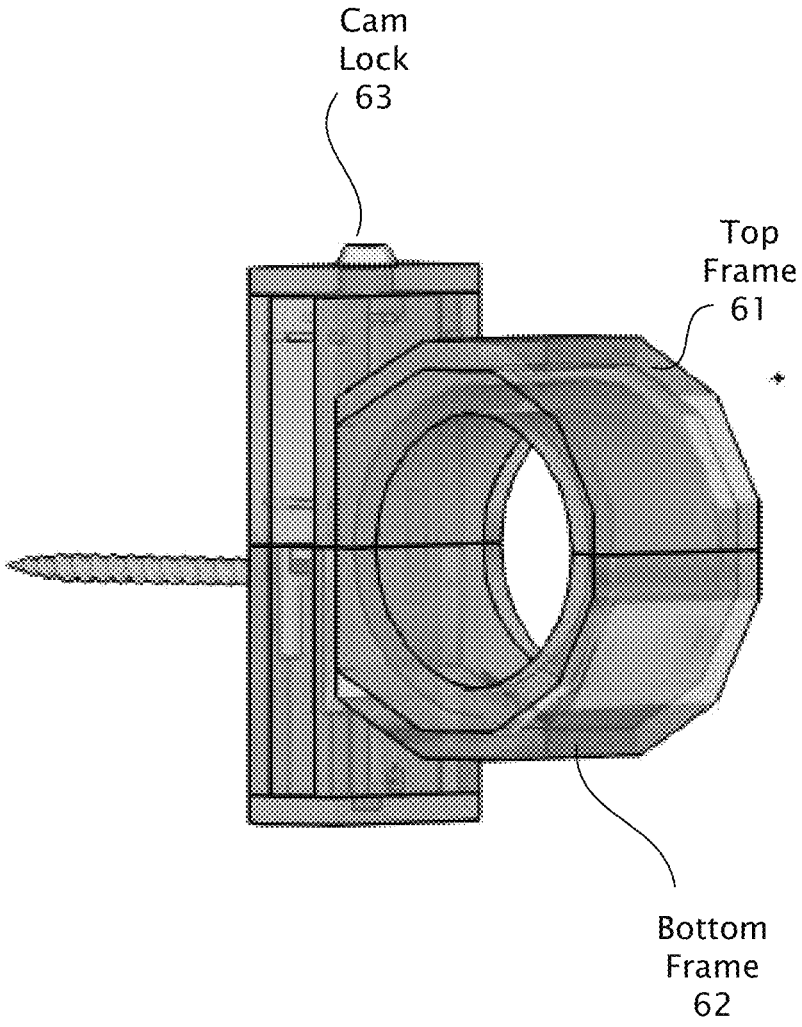
FIG. 4 is an alternative example of the locking gun mount in the closed position.
Figure 5:
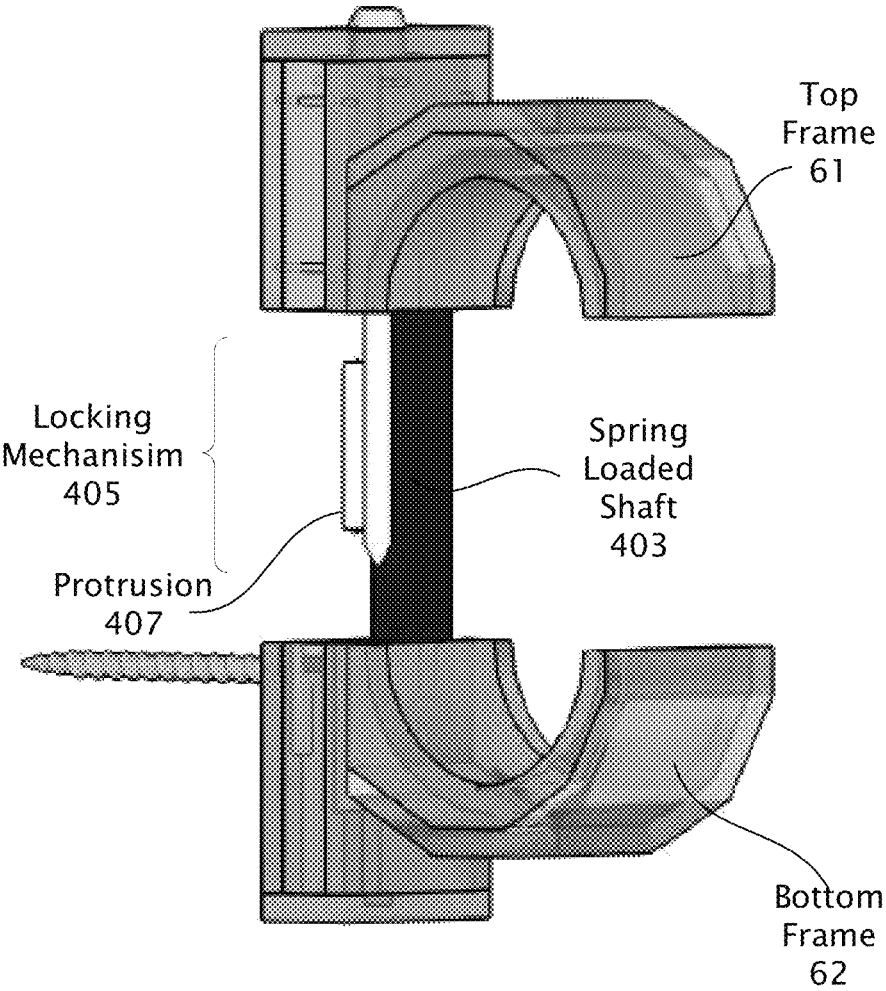
FIG. 5 is an alternative example of the locking gun mount in the open position.

FIGS. 4-5 describe the construction and operation of a second example of a locking gun mount. Although the outer form differs from the previous example, the two examples function in substantially the same manner. The second example of a locking gun mount 401 includes two jaw, top jaw 62 and lower jaw 61 with a spring loaded shaft 403 having each end captively coupled to a respective frame 61, 62 holding them together which allows the locking gun mount 401 to slide open and shut closed. The locking mechanism 405 can turn 90 degrees and lock the jaws together in the closed position by a protrusion 407 being turned to engage a stop (not shown) disposed in the bottom frame.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A locking gun mount comprising:

a top frame having a rectangular spring housing disposed in a back surface of the top frame with a first rectangular tab formed in the top frame along an edge of the top frame and including a top back plate;

a bottom frame having a rectangular spring housing disposed in a back surface of the bottom frame with a second rectangular tab formed in the bottom frame along an edge of the bottom frame aligning with the first tab when the top frame and the bottom frame are in an assembled position, and having a lag mounting depression, shaped to accept a lag screw head including a bottom back plate having an aperture with a lag screw disposed therein, so that the lag screw is prevented from rotating with the lag screw inserted through the aperture and the lag screw head disposed in the lag mounting depression, whereby the bottom frame can be screwed into a mounting surface;

a shaft spring providing bias to separate the top frame from the bottom frame;

a shaft tube having at least a first side, a second side and a middle side disposed there between having a pair of bump stops disposed at opposite ends on an exterior of the shaft tube middle side, with the shaft spring disposed therein and extending past a first end of the shaft tube and a second end of the shaft tube, whereby the shaft tube is slidably disposed in a shaft housing and positioned so that the pair of bump stops are positioned to contact the first tab and the second tab to retain the top frame to the bottom frame in an open position of the locking gun mount;

a cam lock rotably coupled to the top frame, and axially attached to a circular pin, with a first ridge, and a second ridge disposed on a side of the circular pin to form a frame sprag, and the frame sprag slidably disposed in a bottom frame shaft housing and positioned so that the first ridge and the second ridge contact the first tab and the second tab when the cam lock is engaged to close the locking gun mount when the cam lock is rotated to a locked position with the bottom frame is pushed against bias of the shaft spring to contact top frame.

2. The locking gun mount of claim 1 in which the top backplate retains a first portion of the frame sprag to the top frame.

3. The locking gun mount of claim 1 in which the bottom backplate retains a second portion of the frame sprag to the bottom frame.

4. The locking gun mount of claim 1 further comprising a lag shield bearing disposed on the lag bolt.

5. The locking gun mount of claim 1 in which in the closed position the first rectangular tab and the second rectangular tab are held together by the first ridge and the second ridge.

6. The locking gun mount of claim 1 in which in the opened position the first rectangular tab and the second rectangular tab are pushed apart by bias from the shaft spring until stopped by the pair of bump stops contacting, each of which contacts the respective first rectangular tab, and the second rectangular tab.

7. The locking gun mount of claim 1 in which in the shaft tube is prevented from rotatably turning by the interference of a flat side against a mating surface of the shaft housing.

8. The locking gun mount of claim 1 in which the top frame and the bottom frame are made from moly coated stainless steel.

9. The locking gun mount of claim 1 in which the top frame and the bottom frame are made from aluminum.

10. The locking gun mount of claim 1 in which the top frame and the bottom frame are made from nylon.

11. A locking gun mount comprising:

a frame sprag generally of elongate shape and including:

an axial pin having a first pin end and a second pin end;

a cam lock attached to the first pin end;

a first projection on the axial pin; and a second projection on the axial pin positioned in line with the first axial pin so that a tab gap is formed between the first projection and the second projection;

a retaining device including:

a shaft tube having at least three sides at right angles to each other and forming a channel having a channel length, and having a first shaft tube end and a second shaft tube end;

a shaft spring having a spring length greater than the channel length, and slidabaly disposed in the shaft tube;

a first bump stop attached to a side of the at least three sides of the shaft tube; and a second bump stop attached distally from the first bump stop to the side of the at least three sides of the shaft tube;

a top frame with a planar top frame back surface and a top frame edge including;

a top frame shaft and sprag housing forming a depression in the top frame back surface;

a top frame tab formed in the top frame surface edge at a midpoint of the edge; and a top backplate coupled to the planar top frame back surface;

a bottom frame with a planar bottom frame back surface and a bottom frame edge parallel to the top frame edge including:

a bottom frame shaft and sprag housing forming a depression in the bottom frame back surface;

a bottom frame tab formed in the bottom frame surface edge at a midpoint of the edge;

a lag mounting hole formed in the bottom frame back surface; and a bottom backplate coupled to the planar bottom frame back surface.

12. The locking gun mount of claim 11 further comprising a fastener disposed in an aperture in the bottom backplate.

13. The locking gun mount of claim 11 where the tab gap is of a distance greater than the length of the top frame tab and the bottom frame tab.

14. The locking gun mount of claim 11 where the fastener is a lag screw.

15. The locking gun mount of claim 14 where the lag screw includes a lag shield bearing.

16. The locking gun mount of claim 11 in which the top frame and the bottom frame are made from moly coated stainless steel.

17. The locking gun mount of claim 11 in which the top frame and the bottom frame are made from aluminum.

18. The locking gun mount of claim 11 in which the top frame and the bottom frame are made from nylon.

* * * * *